US011433296B2

(12) United States Patent
Pogosyan

(10) Patent No.: US 11,433,296 B2
(45) Date of Patent: Sep. 6, 2022

(54) SHAPE SORTING ACTIVITY DEVICE

(71) Applicant: Areg Alex Pogosyan, Hicksville, NY (US)

(72) Inventor: Areg Alex Pogosyan, Hicksville, NY (US)

( * ) Notice: Subject to any disclaimer, the term of this patent is extended or adjusted under 35 U.S.C. 154(b) by 238 days.

(21) Appl. No.: 17/003,128

(22) Filed: Aug. 26, 2020

(65) Prior Publication Data

US 2022/0062750 A1 Mar. 3, 2022

(51) Int. Cl.
*A63F 9/06* (2006.01)

(52) U.S. Cl.
CPC .... *A63F 9/0666* (2013.01); *A63F 2300/1037* (2013.01); *A63F 2300/30* (2013.01)

(58) Field of Classification Search
CPC ..... A63F 9/0666; A63F 2300/1037; A63F 2300/30; A63F 2009/2422; A63F 2009/1061; A63F 2009/247; A63F 2009/2482; A63F 2009/245; A63F 9/34; A63H 33/046; A63H 33/10; A63H 33/26; G09B 1/38
See application file for complete search history.

(56) References Cited

U.S. PATENT DOCUMENTS 2,416,959 A * 3/1947 Segal ..... A63F 9/08 273/153 R
2,774,150 A * 12/1956 Genin ..... A63F 9/08 434/259
2,963,796 A * 12/1960 Zalkind ..... A63F 9/08 D19/64
3,170,693 A * 2/1965 Felsher ..... F41J 3/0057 273/377
3,235,263 A * 2/1966 Smith ..... A63F 9/12 273/156
3,565,426 A * 2/1971 Glass ..... A63F 9/24 273/156
3,724,854 A * 4/1973 Brooks ..... A63F 9/24 446/454
4,039,184 A * 8/1977 Breslow ..... A63F 3/00643 273/455
4,136,878 A * 1/1979 Caldwell ..... A63F 3/00643 273/237

(Continued)

FOREIGN PATENT DOCUMENTS

CA 2447957 A1 4/2005

*Primary Examiner* — David L Lewis
*Assistant Examiner* — Matthew D Hoel
(74) *Attorney, Agent, or Firm* — Proskauer Rose LLP

(57) ABSTRACT

An activity device is provided that comprises a sorting substrate including multiple cavities, multiple toy blocks shaped and sized for insertion into respective ones of the cavities, and detection circuitry. The detection circuitry includes multiple sensors disposed on the sidewall of each toy block, including a first sensor disposed adjacent to the distal end of the toy block and a second sensor disposed proximally relative to the first sensor. The detection circuitry also includes at least one activator disposed on a side wall of each cavity and configured to (i) activate the first sensor of the corresponding toy block as the toy block is being inserted into the cavity to produce a first stimulus from the toy block and (ii) activate the second sensor of the corresponding toy block when the toy block is seated within the cavity to produce a second stimulus from the toy block.

20 Claims, 5 Drawing Sheets

(56) References Cited

U.S. PATENT DOCUMENTS 4,247,109 A * 1/1981 Horan ..... A63F 7/3065 273/121 A
4,300,762 A * 11/1981 Goldfarb ..... A63F 9/24 273/455
4,323,238 A * 4/1982 Jernstrom ..... A63F 9/12 273/459
4,455,025 A * 6/1984 Itkis ..... G07C 15/006 273/237
4,508,512 A * 4/1985 Girsch ..... G09B 19/00 446/73
4,609,356 A * 9/1986 Gilden ..... G09B 21/007 434/259
4,624,462 A * 11/1986 Itkis ..... A63F 3/0645 273/237
4,874,166 A * 10/1989 Kuna ..... A63F 9/24 273/455
4,952,153 A * 8/1990 McAllister ..... G09B 1/08 434/168
5,149,094 A * 9/1992 Tastad ..... A63F 7/027 273/121 A
5,190,287 A * 3/1993 Ishiyama ..... A63F 9/0666 273/156
5,249,808 A * 10/1993 Batte ..... A63F 3/00006 273/249
5,501,601 A * 3/1996 Todokoro ..... G09B 5/062 434/164
5,674,103 A * 10/1997 Bean ..... A63F 9/0666 220/4.03
5,711,707 A * 1/1998 Zoccole ..... A63F 3/06 273/269
5,752,701 A * 5/1998 Kao ..... A63F 3/0695 273/272
6,626,678 B2 * 9/2003 Forbes ..... A63F 9/0666 273/156
7,219,891 B2 * 5/2007 Giegerich ..... A63F 7/3065 273/108
7,238,026 B2 7/2007 Brown et al.
7,303,193 B2 * 12/2007 Miletich ..... A63B 15/02 273/460
7,445,551 B1 * 11/2008 Okada ..... A63F 13/00 463/43
7,585,216 B2 * 9/2009 Foster ..... A63F 9/10 463/9
7,621,808 B2 * 11/2009 Walker ..... A63F 3/00 463/9
7,789,390 B2 * 9/2010 Giegerich ..... A63F 7/06 273/127 R
7,828,293 B1 * 11/2010 Pruzan ..... A63F 9/0076 273/457
7,985,137 B1 * 7/2011 Klitsner ..... A63F 9/24 463/31
8,201,826 B1 * 6/2012 Johnson ..... A63F 13/22 273/237
8,369,795 B2 * 2/2013 Glaser ..... A63F 13/22 455/73
8,731,482 B2 * 5/2014 Glaser ..... A63F 13/20 455/73
8,821,287 B2 * 9/2014 Okada ..... A63F 13/25 463/42
8,876,604 B2 * 11/2014 Casino ..... A63F 9/24 463/7
9,011,157 B2 * 4/2015 Gunasekaran ..... A63F 9/0666 434/258
9,084,936 B2 * 7/2015 Perlman ..... H04N 21/6125
9,108,107 B2 * 8/2015 Perlman ..... H04N 19/172
9,128,661 B2 * 9/2015 Zilber ..... A63F 13/80
9,205,326 B2 * 12/2015 Okada ..... G06F 3/16
9,308,443 B2 * 4/2016 Glaser ..... A63F 13/26
9,579,560 B2 * 2/2017 Renner ..... A63F 9/0612
9,586,137 B2 * 3/2017 Holme ..... A63F 13/212
9,713,776 B1 * 7/2017 Leung ..... G09B 1/06
9,821,220 B2 * 11/2017 Gupta ..... A63F 9/24
9,849,369 B2 * 12/2017 Maharbiz ..... A63F 13/213
9,925,471 B2 * 3/2018 Flores ..... A63H 18/00
9,999,831 B2 * 6/2018 Chazen ..... A63F 9/0666
10,131,179 B2 * 11/2018 Mess ..... A63F 9/1288
10,150,030 B2 * 12/2018 Perlman ..... H04L 67/10
10,427,032 B1 * 10/2019 Lin ..... A63F 9/0666
10,456,660 B2 * 10/2019 Maharbiz ..... A63F 13/213
10,471,339 B2 * 11/2019 Chazen ..... A63F 9/0666
10,610,754 B2 * 4/2020 Hofmann ..... A63F 9/0604
10,629,083 B1 * 4/2020 Higgins ..... A63F 9/12
10,799,807 B2 * 10/2020 Derraugh ..... A63F 9/10
10,898,823 B2 * 1/2021 Derraugh ..... A63F 9/10
11,247,139 B2 * 2/2022 Catz ..... A63H 17/262
11,260,283 B2 * 3/2022 Morris ..... A63F 9/0666
11,273,365 B2 * 3/2022 Haben ..... A63F 11/0074
11,305,188 B2 * 4/2022 Perlman ..... H04N 21/4307
11,312,173 B2 * 4/2022 Golovata ..... A63F 9/1044
11,344,801 B2 * 5/2022 Perlman ..... H04N 19/172
2002/0006763 A1 * 1/2002 Forbes ..... G09B 21/00 446/1
2003/0038423 A1 * 2/2003 Turner ..... A63F 9/0666 273/157 R
2004/0029088 A1 * 2/2004 Forbes ..... G09B 21/00 600/300
2005/0049023 A1 * 3/2005 Foster ..... A63F 9/10 463/9
2005/0093232 A1 * 5/2005 Stout ..... A63F 9/10 273/153 R
2005/0127601 A1 * 6/2005 Giegerich ..... A63F 7/06 273/108.1
2005/0133995 A1 * 6/2005 Walker ..... A63F 3/00 273/237
2005/0200076 A1 * 9/2005 Wu ..... A63F 9/10 273/157 R
2006/0154725 A1 * 7/2006 Glaser ..... G07F 17/32 463/37
2006/0265974 A1 * 11/2006 Tan ..... A63F 9/10 52/173.1
2007/0085269 A1 * 4/2007 Martin ..... A63F 9/10 273/157 R
2007/0090603 A1 * 4/2007 Miletich ..... A63B 15/00 273/460
2007/0117602 A1 * 5/2007 Madigou ..... A63F 3/00643 463/14
2007/0164513 A1 * 7/2007 Gelman ..... A63F 9/10 273/156
2007/0182093 A1 * 8/2007 Giegerich ..... A63F 7/06 273/108
2007/0278740 A1 * 12/2007 Mao ..... A63F 9/10 273/156
2008/0274779 A1 * 11/2008 Stout ..... A63F 9/10 463/9
2009/0069083 A1 * 3/2009 Okada ..... A63F 13/92 463/31
2009/0118017 A1 * 5/2009 Perlman ..... H04N 21/2343 463/42
2009/0196516 A1 * 8/2009 Perlman ..... H04N 19/107 714/752
2009/0221211 A1 * 9/2009 Ngo ..... A63H 33/22 434/247
2010/0001923 A1 * 1/2010 Zilber ..... G06F 3/1431 345/1.1
2011/0133407 A1 * 6/2011 Kim ..... A63F 1/02 273/293
2011/0163500 A1 * 7/2011 Hsu ..... A63F 3/00006 273/287
2012/0052934 A1 * 3/2012 Maharbiz ..... A63F 13/98 463/9
2012/0146286 A1 * 6/2012 van der Loo ..... A63F 9/0666 273/157 R
2012/0315967 A1 * 12/2012 Watine ..... A63F 9/183 463/9
2013/0069305 A1 * 3/2013 Lee ..... A63F 9/24 273/156
2013/0084979 A1 * 4/2013 Casino ..... A63F 9/24 463/31

(56) References Cited

U.S. PATENT DOCUMENTS

2013/0143662 A1* 6/2013 Glaser ..... A63F 13/22 463/37
2013/0300061 A1* 11/2013 Ben Ezra ..... A63F 9/1208 273/157 R
2014/0228117 A1* 8/2014 Glaser ..... A63F 13/537 463/31
2014/0293045 A1* 10/2014 Horovitz ..... A63F 13/25 348/135
2014/0295965 A1* 10/2014 Okada ..... A63F 13/2145 463/31
2014/0353206 A1* 12/2014 Gunasekaran ..... A63F 9/0001 29/428
2015/0035231 A1* 2/2015 Dyrdahl ..... A63F 9/1044 273/153 S
2015/0079875 A1* 3/2015 Flores ..... A63F 7/3622 446/431
2015/0119122 A1* 4/2015 Holme ..... A63F 13/28 463/7
2015/0321098 A1* 11/2015 van der Laan ..... A63F 13/52 463/31
2016/0030841 A1* 2/2016 Perlman ..... H04L 65/765 463/40
2016/0045821 A1* 2/2016 Okada ..... A63F 9/24 463/31
2016/0158640 A1* 6/2016 Gupta ..... G09B 9/006 463/3
2016/0303471 A1* 10/2016 Renner ..... A63F 9/0666
2017/0036103 A1* 2/2017 Chazen ..... A63F 9/10
2017/0320352 A1* 11/2017 Mess ..... B43K 29/007
2017/0326445 A1* 11/2017 Kim ..... A63F 13/215
2017/0361207 A1* 12/2017 Brumbalow ..... G09F 13/08
2018/0028887 A1* 2/2018 Hofmann ..... A63F 9/0076
2018/0071615 A1* 3/2018 Maharbiz ..... A63F 3/00643
2018/0085624 A1* 3/2018 Choi ..... A63B 23/12
2018/0130364 A1* 5/2018 Dinh ..... G09B 1/36
2018/0229907 A1* 8/2018 Gayer ..... B65D 51/20
2018/0293904 A1* 10/2018 Dinh ..... A63F 9/1208
2018/0296910 A1* 10/2018 Chazen ..... G09B 1/06
2019/0054367 A1* 2/2019 Chiang ..... G09B 27/08
2019/0151756 A1* 5/2019 Perlman ..... A63F 13/12
2019/0176050 A1* 6/2019 Derraugh ..... A63F 9/10
2019/0247743 A1* 8/2019 Moon ..... A63H 9/00
2019/0259288 A1* 8/2019 Serhiyenko ..... G09B 1/06
2020/0078665 A1* 3/2020 Chazen ..... A63F 9/0666
2020/0155959 A1* 5/2020 Derraugh ..... G09B 5/062
2020/0197805 A1* 6/2020 Perlman ..... H04N 19/61
2020/0206619 A1* 7/2020 van der Laan ..... H04N 21/233
2020/0230994 A1* 7/2020 Golovata ..... A63F 9/1044
2020/0246715 A1* 8/2020 Bensussan ..... A63H 33/10
2020/0282299 A1* 9/2020 Morris ..... A63F 9/0666
2020/0316456 A1* 10/2020 Fairhurst ..... A63H 33/00
2021/0106923 A1* 4/2021 Catz ..... A63H 33/003
2022/0032167 A1* 2/2022 McCoy ..... A63F 13/245
2022/0040563 A1* 2/2022 Haben ..... A63F 1/04
2022/0062750 A1* 3/2022 Pogosyan ..... A63F 9/0666

* cited by examiner

SHAPE SORTING ACTIVITY DEVICE

FIELD OF THE INVENTION

The invention generally relates to an activity device that includes a sorting substrate and multiple toy blocks with different shapes for insertion into the sorting substrate.

BACKGROUND

Studies have shown that children habitually seek out objects capable of producing stimuli (e.g., jingling sounds made by a set keys). Such innate sensory abilities and registry mechanism, especially during a child's developing years, can be harnessed to assist childhood learning and development. Even though there are products (e.g., toys) on today's market that can produce stimuli, these products fail to address the learning process directly, but only address the end results. For example, these products at most produce stimuli only at the end of the game, after a correct decision has been made. Therefore, there is a need for activity devices that can provide stimuli at different stages of a game, guiding the child's decision step-by-step as the game progresses.

SUMMARY

The present invention features an activity device, such as a sorting toy, for enhancing/accelerating the learning process for a player (e.g., a child) in shape and orientation recognition. The activity device can include multiple toy blocks shaped and sized for insertion into complementary cavities of a substrate. In some embodiments, each pair of a toy block and cavity is unique; no one toy block can fit in a cavity configured for a different toy block. In some embodiments, each toy block has two or more stimuli that are configured to confirm at different points of an insertion process that a right choice has been made for the selected cavity. For example, once a toy block is matched with the correctly-shaped cavity and at least partially inserted into the corresponding cavity, the toy block can vibrate (or generate another physical stimulus) signaling that the sorting activity is on the right path. In addition, once the toy block is fully inserted in the corresponding cavity, a light-emitting diode (or another physical stimulus) can illuminate to once again confirm a right choice has been made. In some embodiments, the same set of stimuli is generated regardless of the vertical orientation of the toy block with respect to the cavity, e.g., being inserted right side up or upside down, so long as it matches the correct configuration of the cavity being placed. In some embodiments, once all toys are correctly inserted in the corresponding cavities of the sorting substrate, the substrate emits a physical stimulus, such as a sound in the form of a jingle or tone, to confirm and solidify that the entire sorting activity is completed. The activation of the stimuli can be achieved via strategic placement of sensors, activators, batteries, motors, and sound/light emitters disposed throughout the toy blocks and the substrate. In general, by providing multiple different types (e.g., three types) of feedback, at multiple stages (e.g., three stages) of the sorting activity, the present invention is capable of establishing a faster learning pace for the user's cognitive advancement.

In one aspect, the present invention features an activity device that comprises a sorting substrate including a plurality of cavities and a plurality of toy blocks shaped and sized for insertion into respective ones of the plurality of cavities in the sorting substrate. Each toy block defines a body extending from a proximal end surface to a distal end surface along a longitudinal direction, where the distal end surface is the surface first inserted into the corresponding cavity to form a complementary fit with the corresponding cavity. The activity device also includes detection circuitry comprising, for each pair of a toy block and a corresponding cavity, (i) a plurality of sensors disposed on one or more sidewalls of the body of the toy block and (ii) at least one activator disposed on a side wall of the corresponding cavity adapted to interface with the sidewall of the toy block. The plurality of sensors includes a first sensor disposed adjacent to the distal end surface of the toy block along the longitudinal direction and a second sensor disposed proximally relative to the first sensor along the longitudinal direction. The at least one activator is configured to (i) activate the first sensor of the toy block as the toy block is being inserted into the cavity to produce a first stimulus and (ii) activate the second sensor of the toy block when the toy block is seated within the cavity to produce a second stimulus.

In another aspect, the present invention features an activity device that comprises a sorting substrate including a plurality of cavities and a plurality of toy blocks shaped and sized for insertion into respective ones of the plurality of cavities in the sorting substrate. Each toy block defines a body extending from a proximal end surface to a distal end surface along a longitudinal direction, where the distal end surface is the surface first inserted into the corresponding cavity to form a complementary fit with the corresponding cavity. The activity device also includes detection circuitry comprising, for each pair of a toy block and a corresponding cavity, a plurality of sensors disposed on one or more sidewalls of the body of the toy block and at least one bottom activator disposed on the distal surface of the toy block. The plurality of sensors include a first sensor disposed adjacent to the distal end surface of the toy block along the longitudinal direction and a second sensor disposed proximally relative to the first sensor along the longitudinal direction. The detection circuitry also includes, for each pair of a toy block and a corresponding cavity, at least one activator disposed on a side wall of the corresponding cavity and at least one bottom sensor disposed on a bottom surface of the corresponding cavity. The side wall of the cavity adapted to interface with the sidewall of the toy block and the bottom surface of the cavity adapted to interface with the distal surface of the toy block. The at least one activator of the cavity is configured to (i) activate the first sensor of the toy block as the toy block is being inserted into the cavity to produce a first stimulus and (ii) activate the second sensor of the toy block when the toy block is seated within the cavity to produce a second stimulus. The bottom activator of the toy block is configured to activate the bottom sensor of the cavity once the toy block is seated within the cavity.

Any of the above aspects can include one or more of the following features. In some embodiments, the first stimulus is adapted to signal that the toy block insertion is on the right path and the second stimulus is adapted to signal that the toy block insertion is completed.

In some embodiments, the detection circuitry further comprises at least one bottom activator disposed on the distal surface of each of the plurality of toy blocks and at least one bottom sensor disposed on a bottom surface of each of the plurality of cavities. Each bottom activator of a toy block is adapted to activate the corresponding bottom sensor of the corresponding cavity once the toy block is seated within the cavity. The detection circuitry can further comprise circuitry to trigger a third stimulus after all the bottom sensors are activated by their respective bottom activators. In some embodiments, the third stimulus is adapted to signal successful insertion of all the toy blocks into their respective cavities. In some embodiments, each of the first, second and third stimuli comprises a vibration, a sound or a visual signal. The detection circuitry can further comprise one or more light-emitting diodes (LED) for producing the visual signal. In some embodiments, the first, second and third stimuli are different. In some embodiments, the plurality of sensors are aligned along the longitudinal direction on the sidewall of each toy block body. In some embodiments, the second sensor is located at about a center of the sidewall of each toy block and the activator of the corresponding sidewall of the corresponding cavity is located at about a center of the sidewall of the corresponding cavity. In some embodiments, the plurality of sensors disposed on the sidewall of the body of each toy block further comprises a third sensor disposed adjacent to the proximal end surface of the toy block and longitudinally aligned with the first and second sensors.

In some embodiments, each of the plurality of sensors comprises one of an infrared sensor, step switch, lever switch, actuator, magnetic switch or physical button. Each of the plurality of sensors can comprise a reed switch. Each of the plurality of activators can comprise a magnet. In some embodiments, each of the plurality of sensors has a longitudinal body about three times longer than a diameter of the corresponding activator.

In some embodiments, the sorting substrate includes a battery for powering the detection circuitry. The battery can be at least one of rechargeable or replaceable.

In some embodiments, the plurality of toy blocks have different shapes. In some embodiments, each toy block is configured to fit into only one of the plurality of cavities in the sorting substrate.

BRIEF DESCRIPTION OF THE DRAWINGS

The advantages of the invention described above, together with further advantages, may be better understood by referring to the following description taken in conjunction with the accompanying drawings. The drawings are not necessarily to scale, emphasis instead generally being placed upon illustrating the principles of the technology.

DETAILED DESCRIPTION

Figure 1:
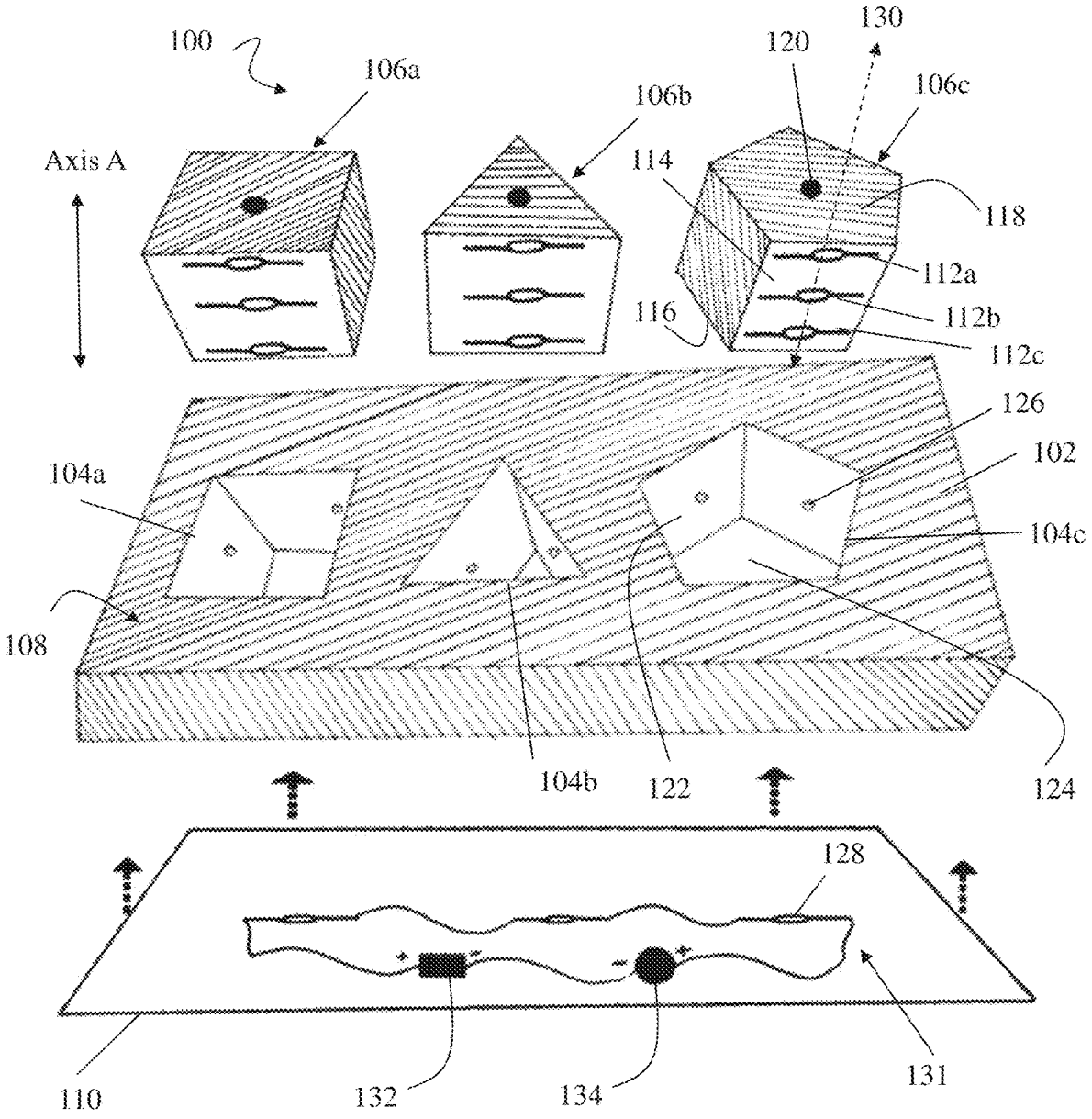
FIG. 1 shows an exemplary activity device including a sorting substrate and multiple toy blocks for insertion into multiple cavities in the sorting substrate, according to some embodiments of the present invention.
Figure 2:
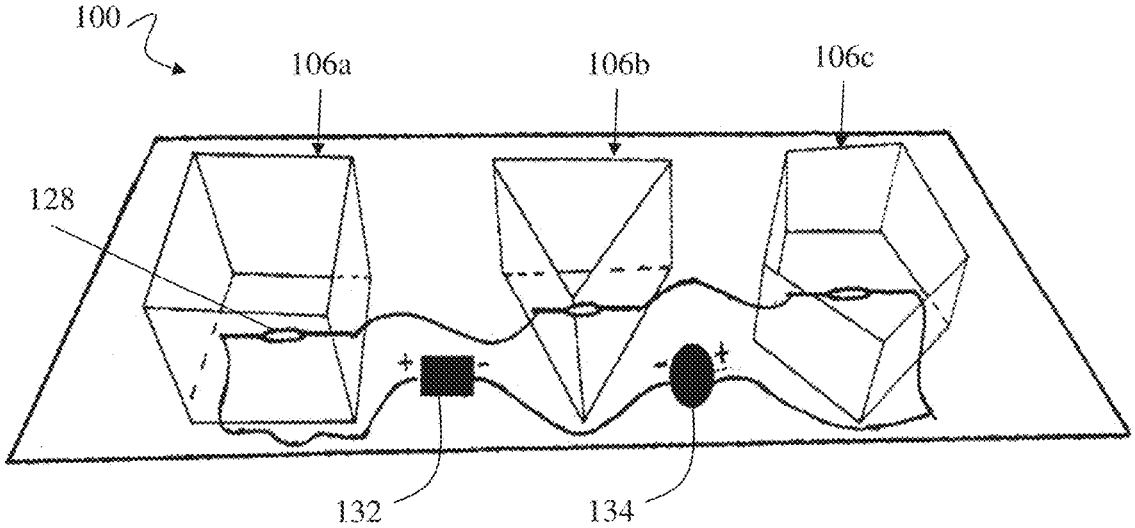
FIG. 2 shows an interior view of the activity device of FIG. 1 after the toy blocks are inserted into their respective cavities in the substrate, according to some embodiments of the present invention.
Figure 3:
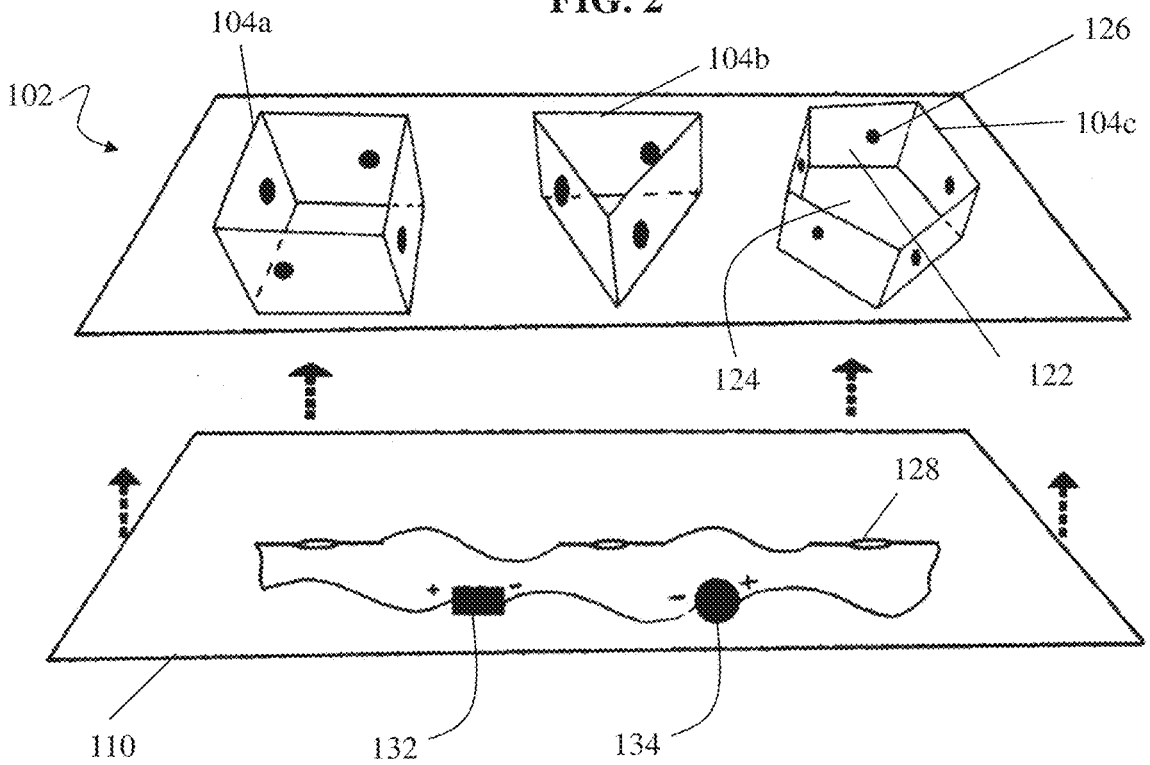
FIG. 3 shows an interior view of the sorting substrate of the activity device of FIG. 1, according to some embodiments of the present invention.

FIG. 1 shows an exemplary activity device 100 including a sorting substrate 102 and multiple toy blocks 106*a-c* for insertion into multiple cavities 104 of the sorting substrate 102, according to some embodiments of the present invention. FIG. 2 shows an interior view of the activity device 100 of FIG. 1 after the toy blocks 106*a-c* are inserted into their respective cavities 104*a-c* in the substrate 102, according to some embodiments of the present invention. FIG. 3 shows an interior view of the sorting substrate 102 of the activity device 100 of FIG. 1, according to some embodiments of the present invention.

As shown in FIGS. 1-3, the sorting substrate includes multiple cavities 104*a-c* shaped and sized to receive corresponding ones of the toy blocks 106*a-c*. Conversely, the toy blocks 106*a-c* are shaped and sized for insertion into respective ones of the cavities 104*a-c* in the sorting substrate 102. In general, each toy block 106 defines a body with a longitudinal axis A extending from a proximal end surface 118 to a distal end surface 116 of the toy block 106. The longitudinal axis A is defined as the direction along which each toy block 106 is inserted into its corresponding cavity 104. The proximal and distal end surfaces 118, 116 each spans a plane substantially normal to the longitudinal axis A, where the distal end surface 116 is defined as the surface that is first inserted into the corresponding cavity 104, and the proximal end surface 118 is opposite from the distal surface 116 along the longitudinal axis A. In some embodiments, each pair of the proximal and distal end surfaces 118, 116 for one toy block 106 has a different shape from that of the proximal and distal end surfaces 118, 116 of another toy block 106. For example, the proximal and distal end surfaces 118, 116 for toy block 106*a* is square/rectangular in shape, the proximal and distal end surfaces 118, 116 for toy block 106*b* is triangle in shape, and the proximal and distal end surfaces 118, 116 for toy bock 106*c* is pentagonal in shape. In general, the end surfaces 118, 116 of the toy blocks 106 can have any polygonal shape. In some embodiments, because the proximal and distal end surfaces 118, 116 for a toy block 106 have the same shape, it does not matter which end surface is inserted first into its corresponding cavity 104 to achieve a complementary fit. Thus, the designation of proximal and distal end surfaces is fluid and depends on which end surface is inserted first into the cavity 104. In some embodiments, each toy block 106 has one or more sidewalls 114 surrounding its body with each sidewall 114 extending between an edge of the proximal end surface 118 and an edge of the distal end surface 116. For example, the toy block 106*a* has four sidewalls, the toy block 106*b* has three sidewalls and the toy block 106*c* has five sidewalls. In general, the number of sidewalls 114 of each toy block 102 is the same as the number of edges that are present in the specific shape of its end surfaces. Each sidewall 114 spans a plane that is substantially parallel to the longitudinal axis A. Details regarding each toy block 106 is described below with reference to FIGS. 4*a*-6*c*.

The substrate 102 can comprise a volume (e.g., a rectangular volume) with a substantially planar top surface 108 and a substantially planar bottom plate 110, where the bottom plate 110 can be detachable from the substrate 102 or integrally formed with the substrate 102. The top surface 108 is defined as the surface to which the cavities 104*a-c* are exposed and from which the toy blocks 106 are received, and the bottom plate 110 is opposite of the top surface 108 once installed. Each cavity 104 can have a cross section that is about the same in size and shape as the size and shape of the proximal and distal end surfaces 118, 116 of the toy block 106 it is configured to receive. In some embodiments, each cavity 104 is configured to receive and fit only one of the toy blocks 106. Each cavity 104 is defined by a bottom surface 124 and one or more side walls 122, where the bottom surface 124 spans a plane that is substantially normal to the longitudinal axis A, and each sidewall 122 extends from an edge of the bottom surface 124 and spans a plane that is substantially parallel to the longitudinal axis A. As shown, the cavity 104*a* has four sidewalls, the cavity 104*b* has three sidewalls, and the cavity 104*c* has five sidewalls. In general, the number of sidewalls 122 of each cavity 104 is the same as the number of edges that are present in the specific shape of its bottom surface 124. Each sidewall 122 of a cavity 104 is shaped and sized to interface with (e.g., in physical contact with) a sidewall 114 of the toy block 106 as the toy block 106 slides into the cavity 104, and the bottom surface 124 of the cavity 104 is shaped and sized to interface with (e.g., in physical contact with) a distal end surface 116 of the corresponding toy block 106 once the toy block 106 is fully seated within the cavity 104.

In some embodiments, the activity device 100 further includes electronic detection circuitry configured to produce one or more visual, audio and/or physical stimuli when a player (e.g., a child) interacts with the activity device 100. The detection circuitry includes electronic components that are coupled to each of the activity blocks 106*a-c* as well as disposed in each of the cavities 104*a-c* and/or within the sorting substrate 102 (such as on the bottom plate 110 of the substrate 102). For example, as shown, each toy block 106 includes multiple sensors 112 disposed on at least one sidewall 114 of the body of the toy block 106. The multiple sensors 112 include a first sensor 112*a* disposed adjacent and closest to the distal end surface 116 of the toy block 106 along the longitudinal axis A. The multiple sensors 112 also include a second sensor 112*b* disposed proximally relative to the first sensor 112*a* on the same sidewall 114 along the longitudinal axis A. The multiple sensors 112 can further include a third sensor 112*c* disposed on the same sidewall 114 adjacent and closest to the proximal end surface 118 of the toy block 106. In some embodiments, the multiple sensors 112 of the sidewall 114 are longitudinally aligned and evenly spaced, such that, for example, the second sensor 112*b* is located at about the center of the side wall 114. For example, the multiple sensors 112 can be aligned relative to a longitudinal line 130 that extends through the centers of the sensors 112. In some embodiments, the same set of sensors 112 is similarly disposed on more than one sidewall 114 of a toy block 106, such as on every sidewall 114 of a toy block 106. In some embodiments, the sensors 112 are disposed only on one sidewall 114 of a toy block 106.

In some embodiments, each toy block 106 further includes at least one end surface activator 121 (shown in FIGS. 4-6) disposed on the distal end surface 116 of the toy block 106. For example, the end surface activator 121 can be located at about the center of the distal end surface 116. Because either the proximal end surface 116 or the distal end surface 118 can be first inserted into its corresponding cavity 104, an end surface activator 120 can also be disposed on the proximal end surface 118 of the toy block 106, such as at about the center of the proximal end surface 118.

For each cavity 104, at least one activator 126 can be disposed on each side wall 122 of the cavity 104. The activator 126 is configured to activate the first sensor 112*c* of the corresponding toy block 106 (adjacent to its distal end surface 116), as the toy block 106 is being inserted into the cavity 104 to produce a first stimulus. As described above, because either the proximal end surface 118 or the distal end surface 116 of a toy block can be first inserted in its corresponding cavity, if the proximal end surface 118 is first inserted, the activator 126 is adapted to trigger the third sensor 112*a* to produce the first stimulus. The first stimulus signals to the player that the toy block 106 is being inserted into the correct cavity 104 and thus the player is on the right path. The activator 126 is also adapted to subsequently activate the second sensor 112*b* of the corresponding toy block 106 when the toy block 106 is fully seated within the cavity 104 to produce a second stimulus. The second stimulus signals to the player that insertion of that particular toy block 106 is completed. For example, one or more stimulus-generating devices, such as a motor 140 for producing physical vibration (shown in FIGS. 4-6), an LED emitter for producing a visual signal (shown in FIGS. 4-6), and/or a sound emitter for producing an audio signal (not shown) can be embedded in the body of each toy block 106 and in electrical communication with respective ones of the sensors 112. Activation of a particular sensor 112 at a particular stage of insertion in turn triggers activation of the stimulus-generating device connected to that sensor.

In some embodiments, the same activator 126 is similarly disposed on every sidewall 122 of the cavity 104 to activate the sensors in the corresponding sidewall 114 of the toy block 106. In some embodiments, the activator 126 is located along the longitudinal line 130, which ensures that it will be physically proximate to the sensors 112 of the corresponding sidewall 114 of the toy block 106 to trigger the sensors 112 during insertion. In some embodiments, the activator 126 of a sidewall 122 of a cavity 104 is located at about the center of the sidewall 122, and the sensors 112 of a sidewall 114 of the corresponding toy block 106 are longitudinally aligned along the centerline 130 of the sidewall 114.

Each cavity 104 can also include at least one bottom sensor 128 disposed on the bottom surface 124 of the cavity 104. The bottom sensor 128 can be activated by the end face activator 121 of the distal end surface 116 of the corresponding toy block 106 once the toy block 106 is fully seated within the cavity 104. In addition, the sorting substrate 102 includes circuitry 131 to trigger a third stimulus after all the bottom sensors 128 of all the cavities 104 are activated by their respective end face activators of the toy blocks 106. The circuitry 131 for producing the third stimulus can be embedded in the substrate volume, such as adjacent to the bottom plate 110 of the substrate 102 or coupled to the bottom plate 110. The third stimulus is adapted to signal to the player the successful insertion of all the toy blocks into their respective cavities, thus the completion of the entire activity. The sorting substrate 102 can also include at least one stimulus generating device 134 (e.g., a motor, a sound-emitting device such as a speaker, or an audio-emitting device such as an LED) for the purpose of generating a stimulus as described above. In an alternative embodiment, a bottom sensor 128 is placed on each block 106 instead of in each cavity 104, where the activator 126 of the cavity 104 can also be configured to trigger the sensor 128.

In some embodiments, each of the first, second and third stimuli comprises a vibration, a sound or a visual signal. If one of the stimuli comprises a visual signal, the activity device can include one or more light-emitting diodes (LED) for producing the visual signal. The LED can be coupled to the toy blocks 106 and/or the substrate 102. In some embodiments, the first, second and third stimuli are different. For example, the first stimulus (produced from the interaction of the sensor 112*c* and the activator 126) can be a sound, the second stimulus (produced from the interaction of the sensor 112*b* and the activator 126) can be a light flashing, and the third stimulus (produced from the interaction of the end face activators of the toy blocks with their bottom sensors 128) can be vibration. In alternative embodiments, all the three stimuli are the same, or two stimuli are the same and the other one is different.

Each of the sensors and/or activators of the activity device 100, including the sensors 112 of the toy blocks 106, the bottom sensors 128 of the substrate 102, and the activators 126 in the substrate 102, can be an infrared sensor, step switch, reed switch, lever switch, actuator, magnetic switch or physical button. For example, all the sensors in the activity device can be reed switches. In some embodiments, each sensor of the activity device 100 has a longitudinal body about three times longer than a diameter of the corresponding activator that is configured to activate the sensor. Each of the activators of the activity device 100, including the activators 126 in the substrate 102 and the end face activators 120, 121 on the toy blocks 106, can be a magnet or another device suitably selected to activate the corresponding sensors. Even though the sensors and the activators of the activity device 100 are shown to be placed at about the center of each wall of the toy blocks 106 and the cavities 104, they can also be placed along the edges or any other locations, as long as these locations ensure correct alignment/activation of the devices for producing the stimuli.

In some embodiments, the sorting substrate 102 includes a power source 132 for powering the electronic detection circuitry of the activity device 100. The power source 132 can be a rechargeable or disposable battery, such a standard 3V button battery that can be replaced when discharged, or a rechargeable lithium ion battery. In some embodiments, each toy block 106 also includes a power source 144 (shown in FIGS. 4-6) that is in the form of a rechargeable or disposable battery. If the power source 144 is rechargeable, it is connected to a charging port 146 (shown in FIGS. 4-6) disposed on a sidewall 144 or an end surface 116, 118 of the toy block 106 to connect to a charger.

Figure 4A:
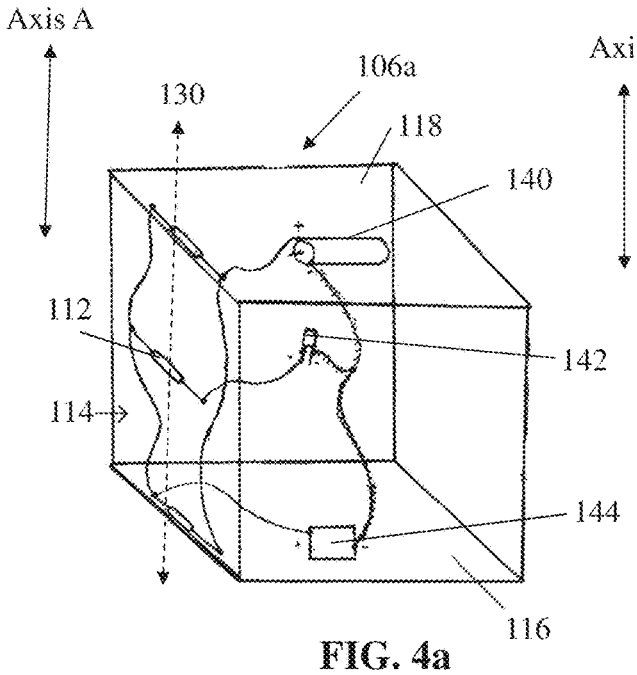
FIGS. 4*a-c* show various views of an exemplary configuration of the cube toy block of the activity device of FIG. 1, according to some embodiments of the present invention.
Figure 4B:
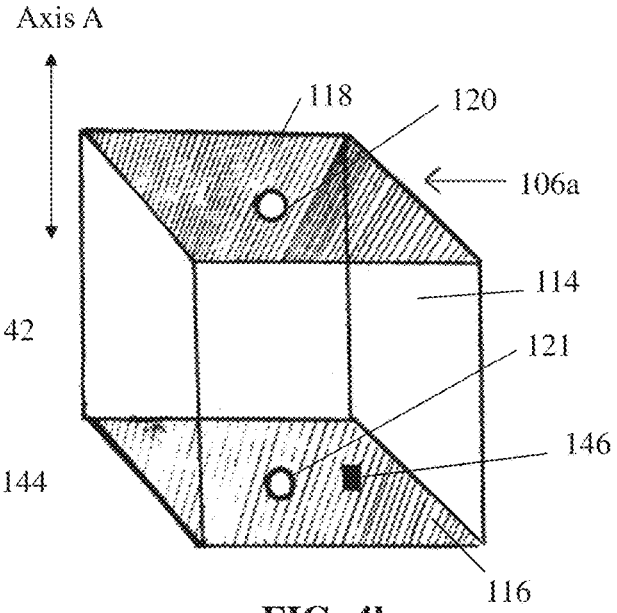
Figure 4C:
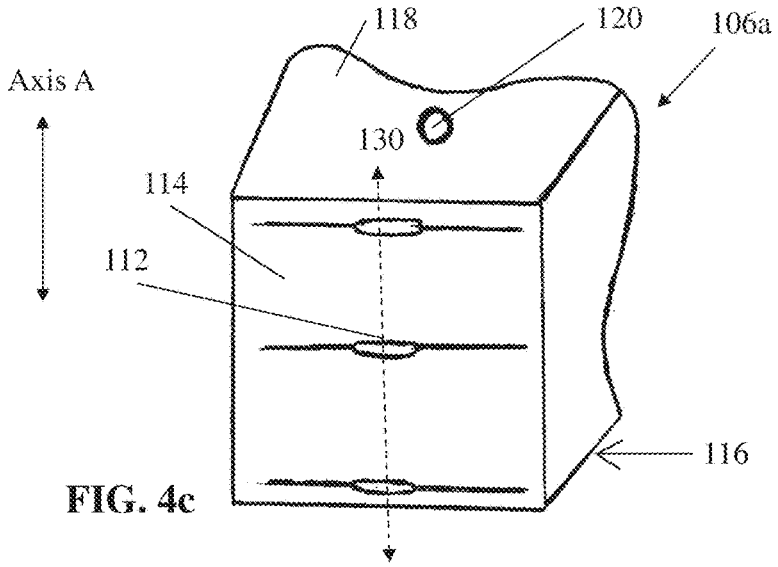

FIGS. 4*a-c* show various views of an exemplary configuration of the cube toy block 106*a* of the activity device 100 of FIG. 1, according to some embodiments of the present invention. As shown, the toy block 106*a* includes a square proximal end surface 118, a square distal end surface 116, and four square sidewalls 114. Each of the four sidewalls 114 can include multiple sensors 112 aligned longitudinally along the longitudinal axis A, such as with respect to the center longitudinal line 130 of the sidewall 114. These sensors 112 are configured to be activated by the activator 126 on the corresponding sidewall 114 of the corresponding cavity 104*a*. The end surface activators 120, 121 can also be disposed on the proximal end surface 118 and the distal end surface 116 of the toy block 106*a*, respectively, where one of which is adapted to interact with the bottom sensor 128 of the corresponding cavity 104*a* depending on which end of the toy block 106*a* is first inserted into the cavity 104*a*. In some embodiments, the motor 140 is embedded in the toy block 106*a* to generate a physical vibration as a stimulus in any one or more stages of completion. The LED 142 can also be embedded in the toy block 106*a* to generate a visual signal as a stimulus in any one or more stages of completion. Further, the power source 144, such as in the form of a replaceable or rechargeable battery, can be embedded in the toy block 106*a* to power the electronic circuitry in the toy block 106*a*. In some embodiments, the charging port 146 is disposed on one of the sidewalls 114 for charging the power source 144 if it is rechargeable.

Figure 5A:
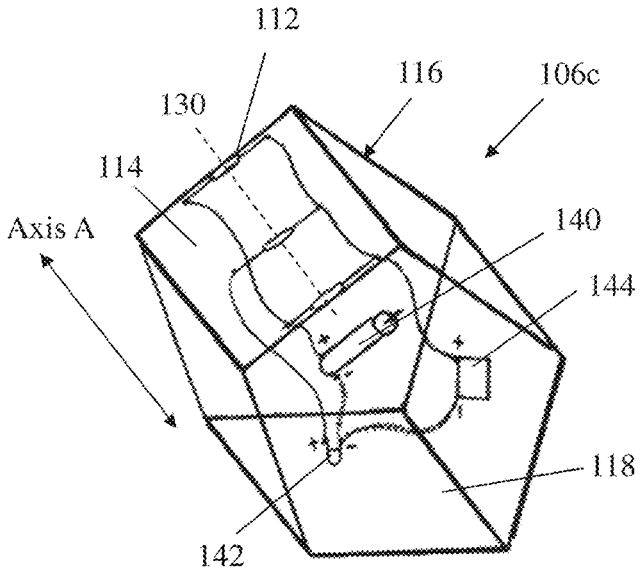
FIGS. 5*a-c* show various views of an exemplary configuration of the toy block with pentagonal end surfaces of the activity device of FIG. 1, according to some embodiments of the present invention.
Figure 5B:
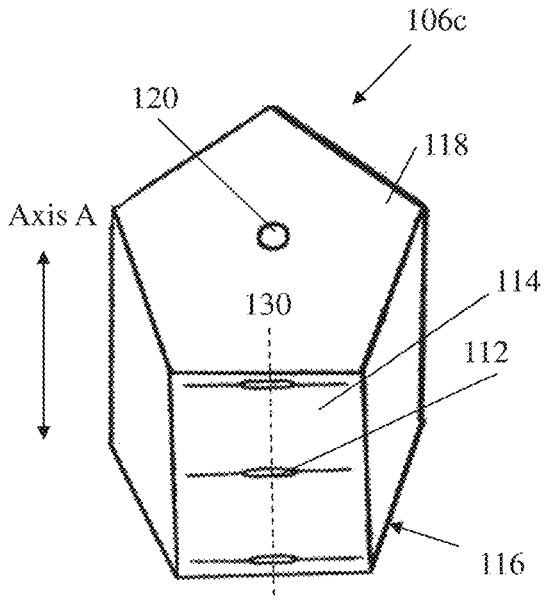
Figure 5C:
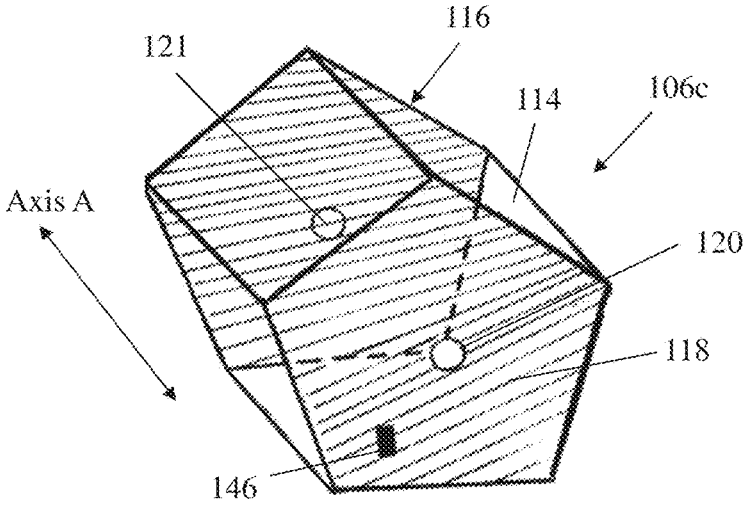

FIGS. 5*a-c* show various views of an exemplary configuration of the toy block 106*c* with pentagonal end surfaces 116, 118 of the activity device 100 of FIG. 1, according to some embodiments of the present invention. As shown, the toy block 106*c* includes a pentagonal proximal end surface 118, a pentagonal distal end surface 116 and five sidewalls 114. Each of the five sidewalls 114 can include multiple sensors 112 aligned longitudinally along the longitudinal axis A, such as with respect to the center longitudinal line 130 of the sidewall 114. These sensors 112 are configured to be activated by the activator 126 on the corresponding sidewall 114 of the corresponding cavity 104*c*. The end surface activators 120, 121 can also be disposed on the proximal end surface 118 and distal end surface 116 of the toy block 106*c*, respectively, where one of which is adapted to interact with the bottom sensor 128 of the corresponding cavity 104*c* depending on which end of the toy block 106*c* is first inserted into the cavity 104*c*. In some embodiments, the motor 140 is embedded in the toy block 106*c* to generate a physical vibration as a stimulus in any one or more stages of completion. The LED 142 can also be embedded in the toy block 106*c* to generate a visual signal as a stimulus in any one or more stages of completion. Further, a power source 144, such as a replaceable or rechargeable battery, can be embedded in the toy block 106*c* to power the electronic circuitry in the toy block 106*c*. In some embodiments, a charging port 146 is disposed on one of the sidewalls 114 for charging the power source 144 if it is rechargeable.

Figure 6A:
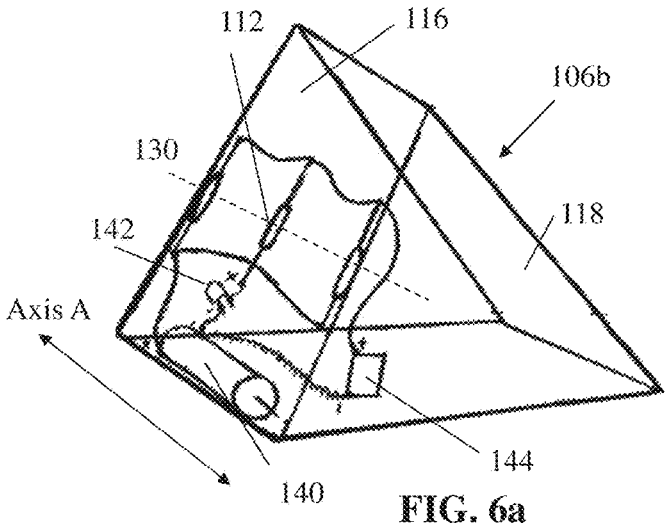
FIG. 6*a-c* show various views of an exemplary configuration of the toy block with triangular end surfaces of the activity device of FIG. 1, according to some embodiments of the present invention.
Figure 6B:
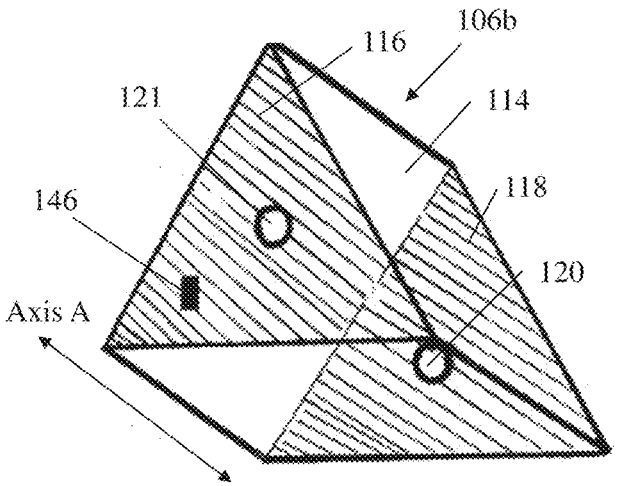
Figure 6C:
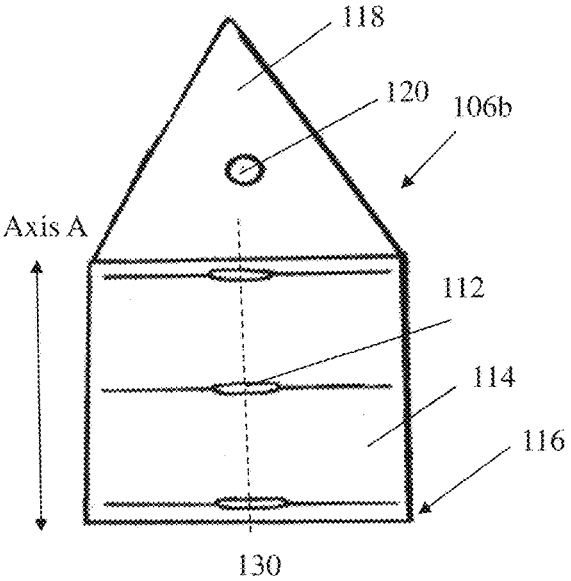

FIG. 6*a-c* show various views of an exemplary configuration of the toy block 106*b* with triangular end surfaces 116, 118 of the activity device 100 of FIG. 1, according to some embodiments of the present invention. As shown, the toy block 106*b* has substantially the same configuration as the toy blocks 106*a*, 106*c* explained above with reference to FIGS. 4*a-c* and 5*a-c*.

In an exemplary operation of the activity device of FIG. 1, as each toy block 106 is in the process of being inserted into its corresponding cavity 104 that provides a complementary fit with the toy block 106, the toy block 106 generates two or more stimuli to confirm at different points of the insertion process that the right choice of the cavities 104 has been made. For example, once a correct toy block 106 is matched with a correct cavity 104 and upon reaching a certain percentage of insertion (e.g., 10%), the toy block 106 begins to vibrate signaling that the player is on the right path. Once the toy block 106 is inserted all the way (i.e., 100%) into the cavity 104, an LED illuminates to once again confirm a right choice has been made. The toy block 106 can emit the same set of stimuli regardless of which end surface 116, 118 is inserted first, so long as the shape of the end surfaces 116, 118 matches the correct cross-sectional shape of the cavity 104. Finally, once all the toys blocks 106 in the activity device 100 are correctly placed, the sorting substrate 102 emits a stimulus, such as a sound (e.g., a jingle or tone), to confirm that the entire sorting activity is completed. The various stages of stimuli production is achieved via precise placement of sensors, activators, power sources and stimulus-generating devices embedded in the toy blocks 106 as well in the sorting substrate 102. By providing the various types of feedback at various stages of the sorting activity, the instant activity device 100 establishes a fast learning pace for the player's cognitive abilities advancement. In general, the activity device 100 can produce any reasonable combinations of stimuli for the different stages of sorting. As another example, each block 106 produces a sound and vibrates during its insertion (at different stages or simultaneously), and when all the blocks 106 are inserted correctly, the sorting substrate 102 illuminates. As yet another example, each block 106 emits a sound and illuminates during its insertion (at different stages or simultaneously), and when all the blocks 106 are inserted correctly, the sorting substrate 102 vibrates. Further, as understood by a person of ordinary skill in the art, more or fewer stages of stimuli can be implemented for the activity device 100 of the present invention. For example, more than three sensors 112 can be coupled to each sidewall 114 of a toy block 106 to increase the number of stages or fewer than three sensors 112 can be coupled to each sidewall 114 to decrease the number of stages. In general, sensors and activators can be placed on one or more sidewalls or corresponding sidewalls of the cavities to produce the same effect.

While the invention has been particularly shown and described with reference to specific embodiments, it should be understood by those skilled in the art that various changes in form and detail may be made therein without departing from the spirit and scope of the invention as defined by the appended claims.

What is claimed is:

1. An activity device comprising:

a sorting substrate including a plurality of cavities;

a plurality of toy blocks shaped and sized for insertion into respective ones of the plurality of cavities in the sorting substrate, each toy block defining a body extending from a proximal end surface to a distal end surface along a longitudinal direction, the distal end surface being the surface first inserted into the corresponding cavity to form a complementary fit with the corresponding cavity; and detection circuitry comprising, for each pair of a toy block and a corresponding cavity:

a plurality of sensors disposed on at least one sidewall of the body of the toy block, the plurality of sensors including a first sensor disposed adjacent to the distal end surface of the toy block along the longitudinal direction and a second sensor disposed proximally relative to the first sensor along the longitudinal direction; and at least one activator disposed on a side wall of the corresponding cavity, the side wall of the cavity adapted to interface with the sidewall of the toy block, the at least one activator being configured to (i) activate the first sensor of the toy block as the toy block is being inserted into the cavity to produce a first stimulus and (ii) activate the second sensor of the toy block when the toy block is seated within the cavity to produce a second stimulus.

2. The activity device of claim 1, wherein the first stimulus is adapted to signal that the toy block insertion is on the right path and the second stimulus is adapted to signal that the toy block insertion is completed.

3. The activity device of claim 1, wherein the detection circuitry further comprises at least one bottom activator disposed on the distal surface of each of the plurality of toy blocks and at least one bottom sensor disposed on a bottom surface of each of the plurality of cavities, wherein each bottom activator of a toy block is adapted to activate the corresponding bottom sensor of the corresponding cavity once the toy block is seated within the cavity.

4. The activity device of claim 3, wherein the detection circuitry further comprises circuitry to trigger a third stimulus after all the bottom sensors are activated by their respective bottom activators.

5. The activity device of claim 4, wherein the third stimulus is adapted to signal successful insertion of all the toy blocks into their respective cavities.

6. The activity device of claim 4, wherein each of the first, second and third stimuli comprises a vibration, a sound or a visual signal.

7. The activity device of claim 6, wherein the detection circuitry further comprises one or more light-emitting diodes (LED) for producing the visual signal.

8. The activity device of claim 4, wherein the first, second and third stimuli are different.

9. The activity device of claim 1, wherein the plurality of sensors are aligned along the longitudinal direction on the at least one sidewall of each toy block body.

10. The activity device of claim 1, wherein the second sensor is located at about a center of the sidewall of each toy block and the activator of the corresponding sidewall of the corresponding cavity is located at about a center of the sidewall of the corresponding cavity.

11. The activity device of claim 1, wherein the plurality of sensors disposed on the at least one sidewall of the body of each toy block further comprises a third sensor disposed adjacent to the proximal end surface of the toy block and longitudinally aligned with the first and second sensors.

12. The activity device of claim 1, wherein each of the plurality of sensors comprises one of an infrared sensor, step switch, lever switch, actuator, magnetic switch or physical button.

13. The activity device of claim 12, wherein each of the plurality of sensors comprises a reed switch.

14. The activity device of claim 1, wherein each of the plurality of activators comprises a magnet.

15. The activity device of claim 1, wherein each of the plurality of sensors has a longitudinal body about three times longer than a diameter of the corresponding activator.

16. The activity device of claim 1, wherein the sorting substrate includes a battery for powering the detection circuitry.

17. The activity device of claim 16, were the battery is at least one of rechargeable or replaceable.

18. The activity device of claim 1, wherein the plurality of toy blocks have different shapes.

19. The activity device of claim 1, wherein each toy block is configured to fit into only one of the plurality of cavities in the sorting substrate.

20. An activity device comprising:

a sorting substrate including a plurality of cavities;

a plurality of toy blocks shaped and sized for insertion into respective ones of the plurality of cavities in the sorting substrate, each toy block defining a body extending from a proximal end surface to a distal end surface along a longitudinal direction, the distal end surface being the surface first inserted into the corresponding cavity to form a complementary fit with the corresponding cavity; and detection circuitry comprising, for each pair of a toy block and a corresponding cavity:

a plurality of sensors disposed on at least one sidewall of the body of the toy block and at least one bottom activator disposed on the distal surface of the toy block, the plurality of sensors including a first sensor disposed adjacent to the distal end surface of the toy block along the longitudinal direction and a second sensor disposed proximally relative to the first sensor along the longitudinal direction; and at least one activator disposed on a side wall of the corresponding cavity and at least one bottom sensor disposed on a bottom surface of the corresponding cavity, the side wall of the cavity adapted to interface with the sidewall of the toy block and the bottom surface of the cavity adapted to interface with the distal surface of the toy block, wherein the at least one activator of the cavity is configured to (i) activate the first sensor of the toy block as the toy block is being inserted into the cavity to produce a first stimulus and (ii) activate the second sensor of the toy block when the toy block is seated within the cavity to produce a second stimulus, and wherein the bottom activator of the toy block is configured to activate the bottom sensor of the cavity once the toy block is seated within the cavity.

* * * * *